US005421181A

United States Patent [19]

Ahrweiler et al.

[11] Patent Number: 5,421,181

[45] Date of Patent: Jun. 6, 1995

[54] HORIZONTAL METAL EXTRUSION PRESS

[75] Inventors: Josef Ahrweiler; Horst Groos, both of Mettmann, Germany

[73] Assignee: SMS Hasenclever GmbH, Dusseldorf, Germany

[21] Appl. No.: 120,180

[22] Filed: Sep. 13, 1993

[30] Foreign Application Priority Data

Sep. 12, 1992 [DE] Germany ..... 42 30 620.5

[51] Int. Cl.[6] ..... B21C 51/00

[52] U.S. Cl. ..... 72/31; 72/35; 72/253.1

[58] Field of Search ..... 72/31, 35, 37, 253.1; 33/520, 644, 661, 710

[56] References Cited

U.S. PATENT DOCUMENTS

| | | | |
|---|---|---|---|
| 3,808,859 | 5/1974 | Cameron | 72/31 |
| 3,919,878 | 11/1975 | Groos | 72/253.1 |
| 4,033,042 | 7/1977 | Bently | 33/661 |

FOREIGN PATENT DOCUMENTS

| | | | |
|---|---|---|---|
| 0379937 | 8/1990 | European Pat. Off. . | |
| 2304326 | 8/1973 | Germany . | |
| 2850576 | 6/1980 | Germany . | |
| 3020156 | 12/1981 | Germany . | |
| 132716 | 6/1988 | Japan | 72/37 |
| 47619 | 2/1991 | Japan | 72/253.1 |
| 1415140 | 11/1975 | United Kingdom . | |
| 2105475 | 8/1982 | United Kingdom . | |

OTHER PUBLICATIONS

Technical Report Hydraulic Presses.

Fachberichte Huttenpraxis Metallweiterverarbeitung.

Japanese Appln. No. 52-129524, filed Oct. 26, 1977, Abstract.

Japanese Appln. No. JP58099706, filed Jun. 14, 1983, Abstract.

*Primary Examiner*—Lowell A. Larson

*Attorney, Agent, or Firm*—Jacobson, Price, Holman & Stern

[57] ABSTRACT

In a horizontal metal extrusion press to enable direct measurement of the alignment of the tools, the moving crosshead (9) and the receiver holder (12) in relation to the press axis, the tie rods (4) of the press frame (3) of high dimensional stability are provided with at least three clearance-measuring probes (25), which are directed at central angles of 120° or less radially towards the press axis (X—X) and are centrally adjustable to a reference clearance from the press axis. The probes are disposed in radial planes (R2, R3, e.g.) in which they detect measuring surfaces (27, 28) provided on and centered at least on the receiver or receiver holder (12) and on the tools, in the working position and/or selected positions of the receiver holder and the tools. To enable the measurements to be effected without stoppages, it is advantageous to provide non-contact clearance-measuring probes, for example measuring on the basis of eddy current, laser or ultrasound.

18 Claims, 3 Drawing Sheets

HORIZONTAL METAL EXTRUSION PRESS

BACKGROUND OF THE INVENTION

The invention relates to a horizontal metal extrusion press, between whose cylinder crosshead and platen or counter-crosshead, which are connected by tie rods, a billet receiver holder and a moving crosshead are guided in a horizontally movable manner. The counter-crosshead which supports the extrusion die during direct extrusion via a die holder and during indirect extrusion via a hollow ram—the die ram, the moving crosshead which is connected to the plunger piston and carries and guides the press ram or a closure piece during indirect extrusion, and the receiver holder have to be aligned with the press axis and guided in such a manner that they retain their alignment in the course of production, particularly throughout the extrusion process, for which purpose adjusting and measuring devices are provided. These adjusting and measuring devices should be capable of checking the in-line axial alignment of receiver and extrusion tools (die, ram and—in the case of hollow extrusion -mandrel) during each extrusion cycle and resetting it in the event of variations owing to changed operating conditions. Commensurate with the critical importance of alignment of receiver and extrusion tools for trouble-free operation of the press and for product quality in general and for multiple and hollow extrusion in particular, there has been no lack of proposed methods of achieving this.

Thus, it is known from German patent document, which corresponds to U.S. Pat. No. 3,808,859, DE-OS 22 38 509 to provide the receiver or the receiver holder, at its end facing the moving crosshead with the press ram, with measuring instruments which detect the radial position of the press ram relative to the receiver in planes which are perpendicular to one another, so that it is possible to center the press ram relative to the receiver at the one end face of the receiver, while centering of the extrusion die in relation to the other end face of the receiver is effected by a central recess in the receiver serving as a seat for the die holder. Centering of the press ram relative to one end face and of the extrusion die relative to the other end face of the receiver, however, does not mean that the axes of press ram, receiver and extrusion die are in alignment, with the result that additional measurements are necessary, such as that of the inclination of the receiver relative to the counter-crosshead, possibly combined with monitoring of the alignment of the press ram relative to the bed plate of the press, along with the constructional outlay and sources of error that this entails.

From German patent documents DE-OS 28 50 576 and DE-OS 30 20 156 a measuring device is known, in which a carrier connected to the press ram carries two transmitters emitting coherent beams of electromagnetic radiation which are parallel to one another and to the press axis, while there are associated with the receiver holder and the die holder, on carriers connected to these holders, radiation receivers which are at the same distance from one another and from the press axis as the transmitters. This solution did not prove successful under operating conditions because it was shown to be susceptible to faults and obstructive and so did not justify its high constructional outlay.

An apparatus which is better adapted to the operating conditions is that according to European patent document EP-A2-0 379 937 in which the receiver holder and the moving crosshead, between the tie rods connecting the cylinder crosshead and the counter-crosshead to form the press frame, are provided with bottom guides taking up the weight and with top hold-down guides, associated with which guides are detecting elements which measure and indicate the position of the receiver holder and the moving crosshead relative to the tie rods. In order to calibrate the detecting elements, the receiver and receiver holder and extrusion tools have to be aligned in advance, which alignment has to be repeated for each tool combination, this being a drawback particularly when press programs of small batch sizes are being run.

BRIEF SUMMARY OF THE INVENTION

The object of the invention is direct measurement of the alignment of the tools, of the moving crosshead and of the receiver holder in relation to the press axis, thereby making it possible to dispense with additional indirect measurements and preliminary adjustments for calibration of the measuring instruments. According to the invention, on the tie rods of the press frame three clearance-measuring probes, at central angles of about 120° C., or more than three probes at correspondingly smaller central angles, which are directed radially towards the press axis and are centrally adjustable to a reference clearance from this press axis, are disposed as measuring devices in radial planes, in which they scan measuring surfaces, which are provided centrally on the receiver or receiver holder and on the tools, in the working position and/or selected positions of the receiver holder and the tools. To enable the measurements to be effected without stoppages, it is advantageous to provide non-contact clearance-measuring probes which, like those measuring on the basis of eddy current, laser or ultrasound, for example, are known per se.

A prerequisite for the arrangement according to the invention of the measuring devices on the tie rods of the press frame is a press frame of high dimensional stability. Since deformations of the press frame directly influence the measuring result, these deformations have to lie within the tolerance range of alignment precision. Press frames which meet this requirement have been known for some time (inter alia "Aluminium" 50 (1974) 7, pages 456 to 461, F. J. Zilges; "Fachberichte Hüttenpraxis Metallverarbeitung" [Technical reports on metallurgical practice: metal working] 18 (1980) 10, pages 951 to 958, Dieter Veltjens; DE 23 31 318 C 3) and their dimensional stability was also utilized in the solution according to European patent document EP-0 379 937 A2. As press frames of high dimensional stability, according to a further feature of the invention, prestressed press frames are used, having precompression rods, which are formed by tension plates or laminations surrounded by square compression columns, to connect the crossheads (cylinder crosshead and counter-crosshead) of the press frame.

BRIEF DESCRIPTION OF THE DRAWINGS

A preferred embodiment of the invention will now be described in detail with reference to the accompanying drawings by way of example wherein.

DETAILED DESCRIPTION OF PREFERRED EMBODIMENT

Figure 1:
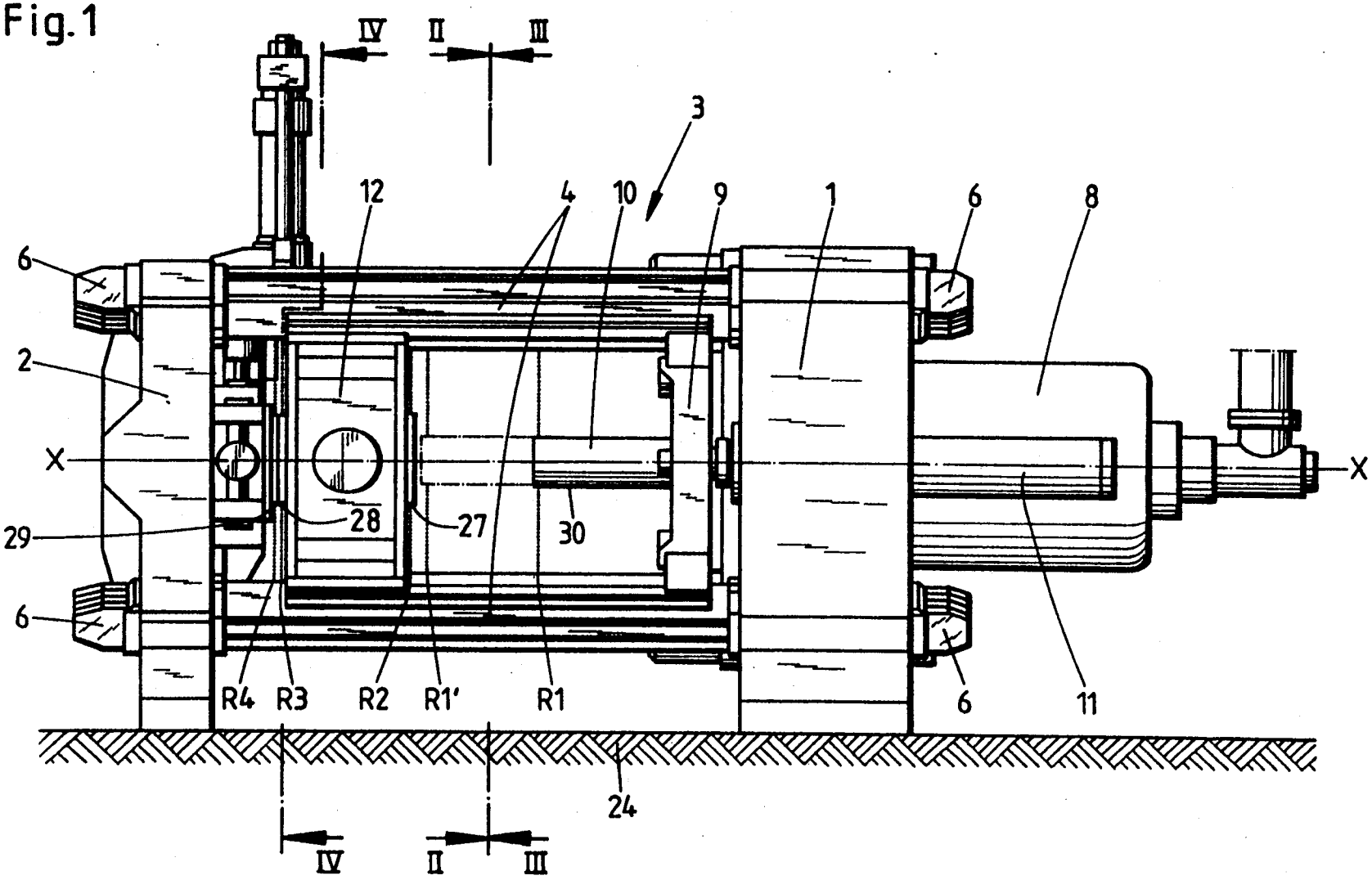
FIG. 1 is a side elevational view of a horizontal metal extrusion press embodying the invention.
Figure 2:
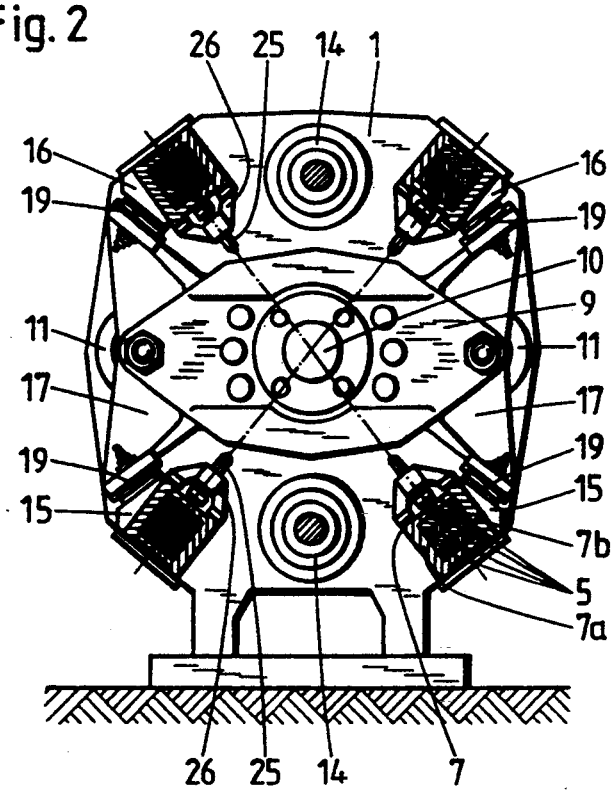
FIG. 2 is a cross-sectional view at right angles to the press axis in the plane A—A taken along II—II in FIG. 1.
Figure 3:
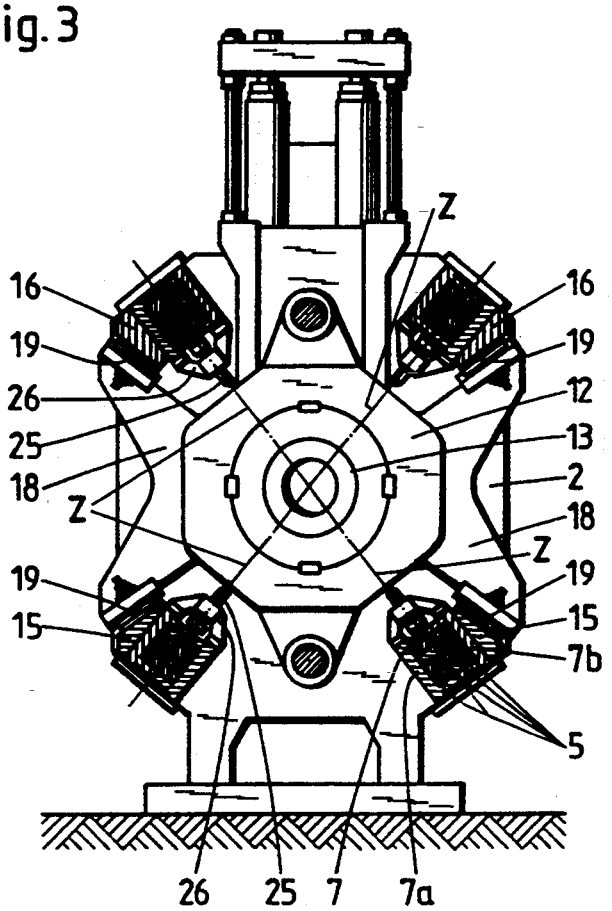
FIG. 3 is a cross-sectional view in the plane A—A taken along line III—III in FIG. 1.
Figure 4:
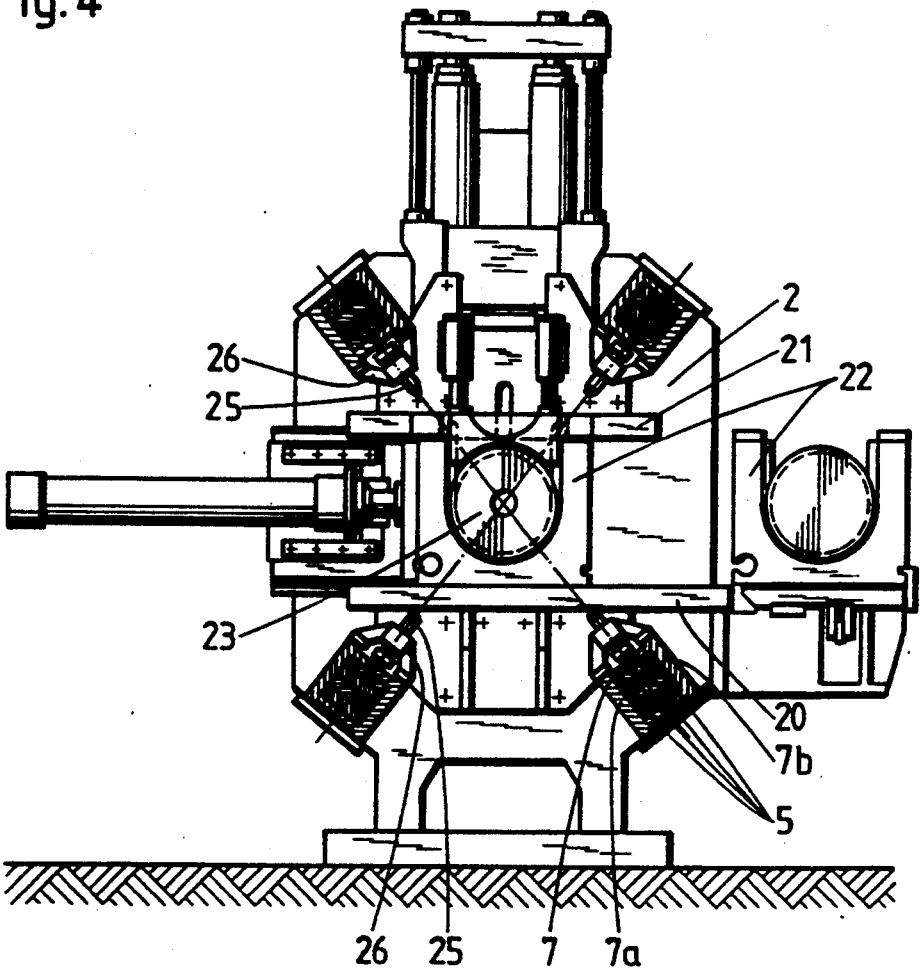
FIG. 4 is a cross-sectional view in the plane B—B taken along line IV—IV in FIG. 1.

The metal extrusion press illustrated in the drawings comprises a cylinder crosshead 1, a counter-crosshead or platen 2, and tie rods or columns 4 connecting these crossheads to form the press frame 3. The tie rods 4 take the form of precompressed rods and comprise tension plates or discs 5, which engage with hammer heads 6 beyond the crossheads (cylinder crosshead 1 and counter-crosshead 2), and square compression columns 7 disposed between the crossheads. The square compression columns 7 are hollow and comprise two U-shaped halves 7a and 7b which are joined together. When the press frame 3 is assembled, the tension discs 5 are preloaded against the square compression columns 7. This construction, known from German patent document DE 23 31 318 C 3, lends the press frame a particularly high degree of dimensional stability.

Connected to the cylinder crosshead 1 is a cylinder 8, in which a piston connected to a moving crosshead 9 may be actuated to perform the extrusion process, whereupon the moving crosshead 9, with a press ram 10 fastened thereto, moves along the press axis X—X. Retraction devices 11 are provided for the return motion of the moving crosshead 9. A receiver holder 12 of a billet receiver 13 is likewise movable along the press axis X—X. The receiver holder 12 is moved by means of piston/cylinder units 14. The moving crosshead 9 and the receiver holder 12 in the course of their movement in the direction of the press axis X—X are guided by the tie rods 4, of which at least the bottom ones are provided with guide ledges 15 for supporting the moving crosshead 9 and the receiver holder 12, although the top ones may also—as in the illustrated embodiment—be provided with guide ledges 16 for holding down the moving crosshead 9 and the receiver holder 12.

The moving crosshead 9 is provided with bracket arms 17 and the receiver holder 12 is provided with bracket arms 18. On the bracket arms 17 of the moving crosshead 9, four guide shoes 19 are disposed in one cross-sectional plane and, on the bracket arms 18 of the receiver holder 12, four guide shoes 19 each are disposed in a first cross-sectional plane positioned closer to the cylinder crosshead 1 and in a second plane positioned closer to the counter-crosshead 2, these guide shoes sliding along the bottom guide ledges 15 and along the top guide ledges 16 respectively. The guide shoes 19 are adjustable relative to the bracket arms 17 or 18 by means of manually operated or motor-driven adjusting means of a known construction, so that the moving crosshead 9 and the receiver holder 12 can be aligned with the press axis X—X.

At the counter-crosshead 2, a cassette 22 for receiving an extrusion die with a die holder 23 is displaceable in guide rails 20, 21 at right angles to the press axis X—X. The extrusion die is supported via the die holder 23 and a thrust ring or a plurality of thrust rings in the extrusion direction on the counter-crosshead 2, and adjusting means are provided on the guide rails 20, 21 for aligning the cassette 22, together with the die holder 23 and extrusion die, centrally relative to the press axis X—X.

During assembly of the metal extrusion press, the cylinder crosshead 1 and the counter-crosshead 2 are aligned on the foundation 24 of the metal extrusion press in such a way that their centers are on a level and coaxial with the press axis X—X. The tie rods 4 comprising the tension plates 5 and the square compression columns 7 are then introduced into the outwardly open slots—which are directed radially relative to the press axis X—X—provided in the crossheads (cylinder crosshead 1, counter-crosshead 2) and are fixed in these slots equidistant from the press axis X—X. In this position, the tension plates 5 and the square compression columns 7 are preloaded against one another.

In four axially spaced radial planes R1, R2, R3 and R4, four circumferentially distributed measuring probes 25 in holders 26 are disposed on the tie rods 4 so that they are directed radially towards the press axis X—X. These measuring probes 25 form non-contact clearance-measuring probes and are each adjustable in their radial planes R1, R2, R3, R4 to a reference clearance centered on the press axis X—X. Measuring surfaces are provided in the form of circular surfaces 27 and 28 which project from the receiver holder 12 and are centered on the receiver bore in the planes R2 and R3, a circular surface 29 On the die holder 23 which projects from the cassette 22 and is centered on the die opening in the plane R4, and the circular surface area 30 of the press ram 10 in the plane R1. These measuring surfaces, which are designed to be coaxial with thee axis X—X, are sensed or scanned by the clearance-measuring probes (measuring probes 25), with identical clearances in the respective planes R1, R2, R3, R4 indicating the central and axial alignment of receiver and extrusion tools, whereas variations in these clearances immediately indicate an error and enable or initiate manually or automatically controlled, motor-driven correction via the adjusting means.

In the illustrated embodiment, the radial measuring planes contain four measuring probes, so that the central angles included between the radially directed axes Z of adjacent probes are close to 90°, depending on the arrangement of the tie rods about the press axis.

More generally, at least three probes are required at a common axial position, to determine accurately and unambiguously the position of a circle formed by the measuring surface, with the probes distributed around the axis. Preferably, the probes are substantially equally distributed around the axis, corresponding to a central angle of approximately 120° between adjacent probes measured at the axis. If there are more than three probes, the central angles are correspondingly smaller, thus being close to 90° in the illustrated embodiment as already mentioned.

The clearance measurements may be effected before and during the extrusion process in specific selected positions of the receiver holder 12 and the tools (ram 10, die holder 23) or possibly—e.g. the position of the press ram 10 in the radial plane R1 in the embodiment and/or in a radial plane R1' positioned closer to the receiver holder 12 in the working position —over a portion of the auxiliary or working motion. It is also possible to effect clearance measurements in specific radial planes at various measuring surfaces, e.g. to effect clearance measurements in the radial planes R1 and R2 (if these planes are as far apart from one another as the radial planes R2 and R3) at the measuring surfaces 27 and 28 on the receiver holder 12 when the latter is correspondingly retracted out of its working position.

The number and arrangement of the radial planes R with the measuring probes 25 depends on the design of the metal extrusion press for the extrusion process to be applied. Thus, in the case of a metal extrusion press set up for hollow extrusion and provided with a mandrel, it is possible to provide a further radial plane with measuring probes for checking the alignment of the mandrel. In the case of metal extrusion presses set up for indirect extrusion it is possible, for checking the alignment of the die ram, to provide measuring probes in two radial planes, namely in the region of the extrusion die and in the region of the ram foot.

What is claimed is

1. A horizontal metal extrusion press comprising in combination:

a press frame which defines a horizontal press axis and comprises, disposed along said axis, an extrusion ram crosshead, a counter-crosshead, and tie rods interconnecting said crossheads, so that said press frame is of high dimensional stability;

a moving crosshead and a billet receiver movable along and guided by said tie rods for movement in the longitudinal direction of said press axis;

an extrusion ram for effecting said movement for extruding a billet contained in said receiver;

extrusion tools mountable along said press axis;

and means for monitoring alignment with said press axis of at least one of said receiver and tools, comprising, at a common axial position, at least three distance-measuring devices mounted on said tie rods and distributed about and directed towards said press axis, and a co-operating measurement surface provided on said at least one of said receiver and tools, said measuring devices being arranged and adapted to measure distances between said devices and said co-operating measurement surface so that said distances measured by said measuring devices provide an indication of the centering with respect to said press axis of said at least one of said receiver and tools.

2. The press as claimed in claim 1 wherein:

said measuring devices comprise measuring probes; and respective measuring probes and a co-operating measurement surface are provided at each of a plurality of said axial positions.

3. The press as claimed in claim 2 wherein:

said measurement surfaces are circular and substantially coaxial with said press axis.

4. The metal extrusion press as claimed in claim 3 wherein:

said press frame is a prestressed press frame further comprising precompression rods comprising tension plates and square compression columns surrounding said tension plates and connecting said cylinder crosshead and counter-crosshead.

5. The horizontal metal extrusion press as claimed in claim 4, wherein:

said measuring devices comprise at least three distance-measuring probes directed at central angles of a value corresponding to the number of probes radially towards said press axis; and said probes are centrally adjustable to a reference clearance from said press axis.

6. The horizontal metal extrusion press as claimed in claim 3, wherein:

said measuring devices comprise at least three distance-measuring probes directed at central angles of a value corresponding to the number of probes radially towards said press axis; and said probes are centrally adjustable to a reference clearance from said press axis.

7. The metal extrusion press as claimed in claim 2 wherein:

said press frame is a prestressed press frame further comprising precompression rods comprising tension plates and square compression columns surrounding said tension plates and connecting said cylinder crosshead and counter-crosshead.

8. The horizontal metal extrusion press as claimed in claim 7, wherein:

said measuring devices comprise at least three distance-measuring probes directed at central angles of a value corresponding to the number of probes radially towards said press axis; and said probes are centrally adjustable to a reference clearance from said press axis.

9. The horizontal metal extrusion press as claimed in claim 2, wherein:

said measuring devices comprise at least three distance-measuring probes directed at central angles of a value corresponding to the number of probes radially towards said press axis; and said probes are centrally adjustable to a reference clearance from said press axis.

10. The press as claimed in claim 1 wherein:

said measurement surface is circular and substantially coaxial with said press axis.

11. The metal extrusion press as claimed in claim 10 wherein:

said press frame is a prestressed press frame further comprising precompression rods comprising tension plates and square compression columns surrounding said tension plates and connecting said cylinder crosshead and counter-crosshead.

12. The horizontal metal extrusion press as claimed in claim 11, wherein:

said measuring devices comprise at least three distance-measuring probes directed at central angles of a value corresponding to the number of probes radially towards said press axis; and said probes are centrally adjustable to a reference clearance from said press axis.

13. The horizontal metal extrusion press as claimed in claim 10, wherein:

said measuring devices comprise at least three distance-measuring probes directed at central angles of a value corresponding to the number of probes radially towards said press axis; and said probes are centrally adjustable to a reference clearance from said press axis.

14. The metal extrusion press as claimed in claim 1 wherein:

said press frame is a prestressed press frame further comprising precompression rods comprising tension plates and square compression columns surrounding said tension plates and connecting said cylinder crosshead and counter-crosshead.

15. The horizontal metal extrusion press as claimed in claim 1, wherein:

said measuring devices comprise at least three distance-measuring probes directed at central angles of a value corresponding to the number of probes radially towards said press axis; and said probes are centrally adjustable to a reference clearance from said press axis.

16. The metal extrusion press as claimed in claim 15 wherein:

said probes are non-contact distance-measuring probes selected from the group consisting of probes based on eddy current, laser and ultrasound.

17. The metal extrusion press as claimed in claim 16 wherein:

said press frame is a prestressed press frame further comprising precompression rods comprising tension plates and square compression columns surrounding said tension plates and connecting said cylinder crosshead and counter-crosshead.

18. The metal extrusion press as claimed in claim 15 wherein:

said press frame is a prestressed press frame further comprising precompression rods comprising tension plates and square compression columns surrounding said tension plates and connecting said cylinder crosshead and counter-crosshead.

* * * * *